US012011104B2

(12) United States Patent
Gong

(10) Patent No.: US 12,011,104 B2
(45) Date of Patent: Jun. 18, 2024

(54) SPLICED FRAME

(71) Applicant: ZHEJIANG WADOU CREATIVE ART CO., LTD., Zhejiang (CN)

(72) Inventor: Xinming Gong, Zhejiang (CN)

(73) Assignee: Zhejiang Wadou Creative Art Co., Ltd., Jinhua (CN)

( * ) Notice: Subject to any disclaimer, the term of this patent is extended or adjusted under 35 U.S.C. 154(b) by 148 days.

(21) Appl. No.: 17/899,637

(22) Filed: Aug. 31, 2022

(65) Prior Publication Data

US 2023/0404297 A1 Dec. 21, 2023

(30) Foreign Application Priority Data

Jun. 17, 2022 (CN) ..... 202210691847.3

(51) Int. Cl.
*G09F 1/12* (2006.01)
*A47G 1/10* (2006.01)

(52) U.S. Cl.
CPC ..... *A47G 1/102* (2019.08)

(58) Field of Classification Search
CPC ..... B44D 3/185; A47G 1/10; G09F 15/0012; G09F 13/0413; G09F 13/0445; G09F 15/0025; G09F 15/0018
See application file for complete search history.

(56) References Cited

U.S. PATENT DOCUMENTS 796,838 A * 8/1905 Fraser ..... A47G 1/10 40/784
2,185,084 A * 12/1939 Hutaff, Jr. ..... B60R 13/105 248/316.5
2,838,081 A * 6/1958 Larson ..... B25B 5/142 269/88
3,849,920 A * 11/1974 Trowbridge ..... A47G 1/10 40/784
4,076,438 A * 2/1978 Bos ..... E06B 3/982 403/402
4,373,279 A * 2/1983 Abel ..... B44D 3/185 248/490

(Continued)

FOREIGN PATENT DOCUMENTS

WO WO 2017/014651 A1 1/2017

OTHER PUBLICATIONS

Extended European Search Report dated Aug. 22, 2023 for corresponding Europe Application No. 22194448.1.

*Primary Examiner* — Shin H Kim

(57) ABSTRACT

The present disclosure discloses a spliced frame comprising: an outer frame, which is closed and is formed by a plurality of framed profiles, and the ends of adjacent framed profiles being connected to form a frame corner; a pushrod having two ends slidably abutting against inside walls of the adjacent framed profiles respectively, the pushrod and two framed profiles abutting against the pushrod forming a triangular connection; a corner clip comprising an upper patch being fixedly mounted on upper end surfaces of the framed profiles and an inner flap being folded inward and extended to an inside of the outer frame, and the inner flap being provided with a positioning hole; and a positioning rod passing through a through hole of the pushrod and the positioning hole in turn, and provided with a fastening structure for restricting a relative position between the pushrod and the corner clip.

10 Claims, 7 Drawing Sheets

(56) References Cited

U.S. PATENT DOCUMENTS

| | | | | |
|---|---|---|---|---|
| 4,519,151 | A * | 5/1985 | Johnson | B44D 3/185 160/374.1 |
| 4,718,184 | A * | 1/1988 | Sherman | A47G 1/102 403/402 |
| 6,339,891 | B1 * | 1/2002 | Cox | A47G 1/101 403/294 |
| 10,421,315 | B2 * | 9/2019 | Roy | B25B 5/00 |
| 11,087,649 | B2 * | 8/2021 | Anderson | G09F 13/0413 |
| 2009/0057364 | A1 * | 3/2009 | Ocampo | B44D 3/185 226/195 |
| 2009/0178321 | A1 * | 7/2009 | Kucharski | A47G 1/08 40/700 |
| 2012/0267062 | A1 | 10/2012 | Ainge | |
| 2018/0072093 | A1 * | 3/2018 | Roy | B44D 3/18 |
| 2022/0165186 | A1 * | 5/2022 | Colpaert | E06B 9/24 |
| 2023/0404297 | A1 * | 12/2023 | Gong | A47G 1/102 |

* cited by examiner

SPLICED FRAME

CROSS REFERENCE OF RELATED APPLICATIONS

This application claims priority to Chinese Patent Application No. 202210691847.3, filed on Jun. 17, 2022, entitled "SPLICED FRAME", and the contents of which are explicitly incorporated herein by reference.

TECHNICAL FIELD

The present disclosure relates to the technical field of decorative painting, in particular to a spliced frame.

BACKGROUND

Decorative painting is a kind of art which integrates decorative function and aesthetic appreciation. With the progress and development of science and technology, the carriers and forms of decorative painting are becoming more and more abundant, which greatly improves people's pursuit and love of quality life. In decoration paintings for interior walls, frames will be designed in order to match with high-grade oil paintings and original works. Such frames present a variety of styles, appear magnificent and elegant, and have slightly higher prices. A frame is mainly used for positioning four sides of a work and enhancing its aesthetic, and also prevents the work from being damaged due to long-term large-area exposure to the air.

For a picture equipped with a frame, it is basically a finished product after assembly, while the decorative picture of the finished product occupies a large space, which will greatly increase a logistics cost and occupy a storage space of a warehouse. Moreover, if a packaging is not good, it is also easy to break edges and corners of the decorative picture. Especially for a decorative picture with a large surface, an assembled finished product may not be easily carried into a room due to its large horizontal and vertical lengths. Therefore, there are some decorative pictures equipped with detachable frames on the market. However, such decorative paintings with detachable frames on the market have the following defects:

1. after a frame is spliced, the connecting structure between the adjacent framed profiles is unstable, and is only connected by simple clips or kits, which is easy to be deformed after long-time display, and even leads to the structure being scattered in serious cases, thus there are potential safety hazards;

2. during installation, it is impossible to determine approximate placement positions of framed profiles, if an operation is not proper, relevant connecting members may be damaged, and the edges connection of the assembled product may not be flat, and cannot fit a canvas; and 3. once the structure of the frame is deformed or scattered, the canvas cannot be installed, or the installed canvas is uneven, or the canvas will be damaged, resulting in great losses.

SUMMARY

In order to solve the above problem, the present disclosure provides a spliced frame.

The technical solution adopted by the present disclosure is: a spliced frame, wherein the spliced frame includes:

an outer frame, which is closed and is formed by a plurality of framed profiles which are spliced with each other through their ends, and the ends of adjacent framed profiles being connected to form a frame corner;

a pushrod having two ends slidably abutting against inside walls of the adjacent framed profiles respectively, the pushrod and two framed profiles abutting against the pushrod forming a triangular connection, and the pushrod being provided with a through hole;

a corner clip mounted on the frame corner, and comprising an upper patch and an inner flap which are folded at an angle to each other, the upper patch being fixedly mounted on upper end surfaces of the framed profiles, and the inner flap being folded inward and extended to an inside of the outer frame, and the inner flap being provided with a positioning hole; and a positioning rod, which passes through the through hole and the positioning hole in turn, and is provided with a fastening structure for restricting a relative position between the pushrod and the corner clip.

It should be noted that if there are four framed profiles, an outline of the outer frame is rectangular, and if there are three framed profiles, the outline of the outer frame is triangular, and the framed profiles of different lengths or of the same length can be designed according to requirements to be suitable for a subsequent canvas installation.

Several alternative modes are also provided below, but they are not an additional limitation to the above overall solution, but only a further supplement or optimization. On the premise of no technical or logical contradiction, each alternative mode can be combined separately for the above overall solution, or multiple alternative modes can be combined.

In some embodiments, the ends of the adjacent framed profiles are closely spliced with inclined surfaces, and the upper patch is transversely connected between the adjacent framed profiles.

In some embodiments, opposite ends of the upper patch are respectively provided with a pin downwardly folded, and two sides of each of the upper end surfaces of the framed profiles along a length direction are respectively provided with a clamping hole in which the pin is inserted.

Here, the design of the corner clip has two advantages: one is that during the installation process, a relative position between adjacent framed profiles can be approximately orientated, and since adjacent framed profiles are joined obliquely, inclined surfaces of the adjacent framed profiles can be abutted against each other to substantially determine the relative position during the installation process, and then the corner clip is mounted thereon, and the upper patch is transversely connected onto an upper side of a spliced position of the inclined surfaces, and two pins are respectively connected to the two adjacent framed profiles, thereby serving as a primary fixing function for the two adjacent framed profiles, and the corner clip is generally made of metal, which has strong deformation resistance and can effectively reduce a change degree of position between the adjacent framed profiles in subsequent operations; and the other is that it can play the role of installation linkage with the pushrod and the positioning rod in subsequent installation and fixation processes to form a stable triangular structure, the pushrod and the two framed profiles abutting against the pushrod form a triangular configuration after the installation, the fastening structure is used to fasten and maintain the triangular configuration, which is extremely stable, when a position of the corner clip changes to a certain extent (equivalent to a loosening of structure between the adjacent framed profiles), the positioning rod will apply the corner clip a lateral force to prevent the loosening, if a deformation is required, it is also necessary to bend a connecting position of the positioning rod and the pushrod, or to deform the positioning hole to change a relative position of a connecting position of the positioning hole and the positioning rod, which undoubtedly requires overcoming a large force, and it means that by the above-described structure, the position of the corner clip does not change and the relative positions of the framed profiles do not change when the spliced frame in the technical solution has been assembled, and thus the structure is extremely stable.

In addition, in order to facilitate an installation of the corner clip, each of two ends of the inner flap connected to the upper patch is provided with an arc transition to form an arc angle.

In some embodiments, each of the inside walls of the framed profiles is provided with a sliding bar extending in a length direction thereof, and each of the two ends of the pushrod is inclined and provided with a sliding groove in which the sliding bar can be slide.

Here, the sliding bar defines upper and lower positions of the two ends of the pushrod on the inside wall of the framed profile. Moreover, the design of the positioning rod and the corner clip can effectively prevent a relative position of the pushrod from changing. It is equivalent to that the adjacent framed profiles, the corner clip, the positioning rod and the pushrod are linked with each other, and after a relative position of each structure are fastened by the fastening structure, a finished structure is extremely stable.

In some embodiments, the frame is provided with a spread state in which inclined surfaces at the two ends of the pushrod closely abut against the inside walls of the framed profiles.

In some embodiments, a through hole is provided through a middle position on a side of the pushrod, and pushrod and the positioning rod are perpendicular to each other. It should be noted that the through hole is located at the middle position of the side of the pushrod only when an outer contour of the outer frame is a regular polygon. When a user selects the framed profiles of different lengths, that is, when the outer contour of the outer frame is a non-regular polygon, the pushrod is still required to be kept perpendicular to the positioning rod, but the position of the through hole on the side of the pushrod can be adjusted adaptively according to an actual situation.

In some embodiments, the positioning hole comprises an opening and a slot communicating with each other, wherein a bore diameter of the opening is larger than a bore diameter of the slot. Furthermore, the slot is located below the opening.

In some embodiments, the slot is a strip-shaped slot, and the positioning rod is engaged into the strip-shaped slot in the spread state.

In some embodiments, the fastening structure comprises a threaded rod, a nut and a limit block, wherein the threaded rod integrally extends along a length direction of the positioning rod, and in the spread state, the nut is screwed on the threaded rod and abutted on the pushrod, the limit block is provided at one end of the positioning rod away from the threaded rod, and an inner diameter of the limit block is between the bore diameter of the opening and the bore diameter of the slot.

During an installation, one end of the positioning rod with the limit block can be firstly extended into the opening, and then the positioning rod is move downward, so that the positioning rod is engaged in the slot, and the limit block serves as an anti-detachment and limit for the positioning rod. In order to facilitate the installation, it is generally preferable to use a horn nut. The horn nut is rotated until the horn nut abuts on the pushrod, thereby a fastening is achieved.

In some embodiments, two sides of a lower end surface of the framed profile along the length direction are respectively provided with at least one screw hole, and in the spread state, a corner connector is mounted on a lower end surface of the frame corner through the at least one screw hole. The corner connector is provided with a plurality of holes through which screws can pass, and the holes are positioned in correspondence with the screw holes. Here, the corner connector is configured to further limit the relative position of adjacent framed profiles in order to make the structure more stable.

The installation process of this technical solution is briefly described as follows:

First, two framed profiles are preliminarily spliced through the inclined surfaces of the ends, and then two pins of the corner clip are respectively clamped into the clamping holes of the two framed profiles, in order to preliminarily fix the relative positions of the two framed profiles (it should be noted that when the corner clip has been installed, the framed profiles are pulled outwards, otherwise the structure of the corner clip is easily destroyed), at this time, the upper patch of the corner clip is attached to the upper end surface of the frame corner, the inner flap is folded inside the frame corner, and then the limit block is inserted into the opening of the inner flap, and the positioning rod connected to one end of the limit block also passes through the opening, and when the positioning rod loses support, it will fall into the slot. Next, the sliding groove at one end of the pushrod is slide along the sliding bar of one of the framed profiles, and finally the sliding groove at the other end of the pushrod is slide on the sliding bar of the other framed profile. It should be noted that the position of the positioning rod in the slot is required to be determined before the sliding groove at the other end of the pushrod is slid onto the sliding bar of the other framed profile, so that the threaded rod at the other end of the position rod can pass through the through hole, and finally the two framed profiles, the pushrod, the positioning rod and the corner clip can be fastened in relative positions by screwing the horn nut.

Compared with the prior art, the present disclosure has the following advantageous effects:

1. the triangular stability principle is utilize to make the connection structure between adjacent framed profiles extremely stable, no deformation occurs after long-time use, and a flatness of a subsequent installation of a canvas can be ensured, so that a product quality is effectively improved;
2. due to a high tensile strength of a corner clip on the frame, it can be used for a preliminary positioning between adjacent framed profiles without deformation, which can effectively reduce the difficulty of installation and ensure the flatness of edges connection of the final installation product; and
3. the installation is simple and can be easily realized according to the operation steps.

BRIEF DESCRIPTION OF THE DRAWINGS

In order to more clearly explain the embodiments of the present disclosure or the technical solution in the prior art, the following will briefly describe the drawings which are necessary for the description of the embodiments or the prior art. Obviously, the drawings in the following description are only some embodiments of the present disclosure, and for those skilled in the art, other drawings may also be obtained from the structure shown in the drawings on the premise of no creative labor.

Figure 1:
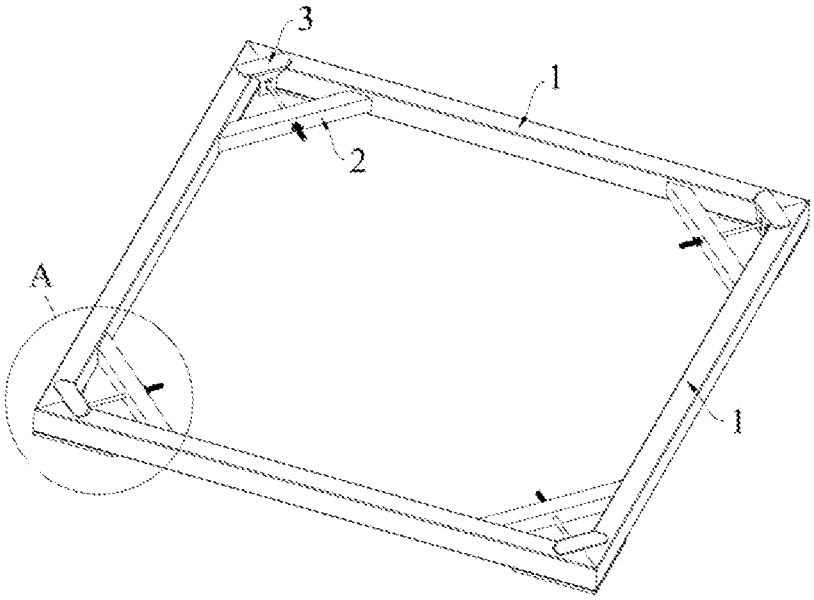
FIG. 1 is a structural diagram showing a front axis side of a spliced frame according to the present disclosure.

Reference sighs: 1—framed profile, 101—clamping hole, 102—screw hole, 2—pushrod, 201—through hole, 3—corner clip, 301—upper patch, 302—inner flap, 3021—opening, 3022—slot, 3023—arc angle, 303—pin, 4—positioning rod, 401—threaded rod, 402—limit block, 5—horn nut, 6—corner connector, 7—screw, 8—canvas, 801—edgefold, 802—first fold, 803—second fold, 9—paster.

The realization of the purpose, the functional characteristics and the advantages of the present disclosure will be further described with reference to the attached drawings in combination with the embodiments.

DESCRIPTION OF THE EMBODIMENTS

In the following, the technical solution in the embodiments of the present disclosure will be clearly and completely described with reference to the drawings in the embodiments of the present disclosure. Obviously, the described embodiments are only one part of the embodiments of the present disclosure, and not all embodiments. Based on the embodiments in the present disclosure, all other embodiments obtained by those skilled in the art without making creative labor belong to the scope of the protection of the present disclosure.

It should be noted, all directional indications (such as up, down, left, right, front, back . . . ) in the embodiments of the present disclosure only are used to explain the relative positional relationship between the components in a particular attitude (as shown in the drawings), if the particular attitude changes, the directional indications change accordingly.

In addition, the description of "first," "second," etc. in the present disclosure is used for descriptive purpose only and is not to be understood as indicating or imply their relative importance or implicitly indicate the number of indicated technical features. Thus, features defined with "first," "second" may explicitly or implicitly include at least one such feature. In addition, the technical solutions among the various embodiments may be combined with each other, but must be based on the implementation by those skilled in the art. When the combination of the technical solutions is contradictory to each other or cannot be realized, it should be considered that the combination of the technical solutions does not exist and is not within the protection scope of the present disclosure.

Figure 2:
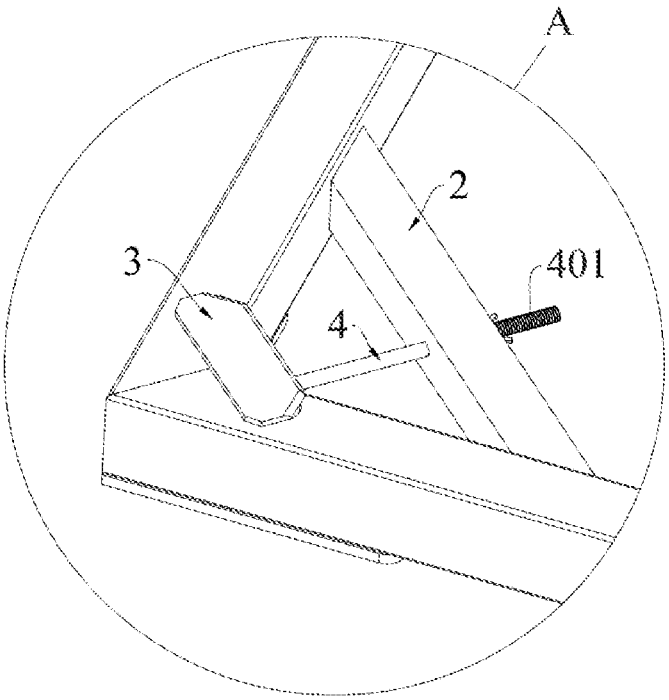
FIG. 2 is a partially enlarged view of part A in FIG. 1.
Figure 3:
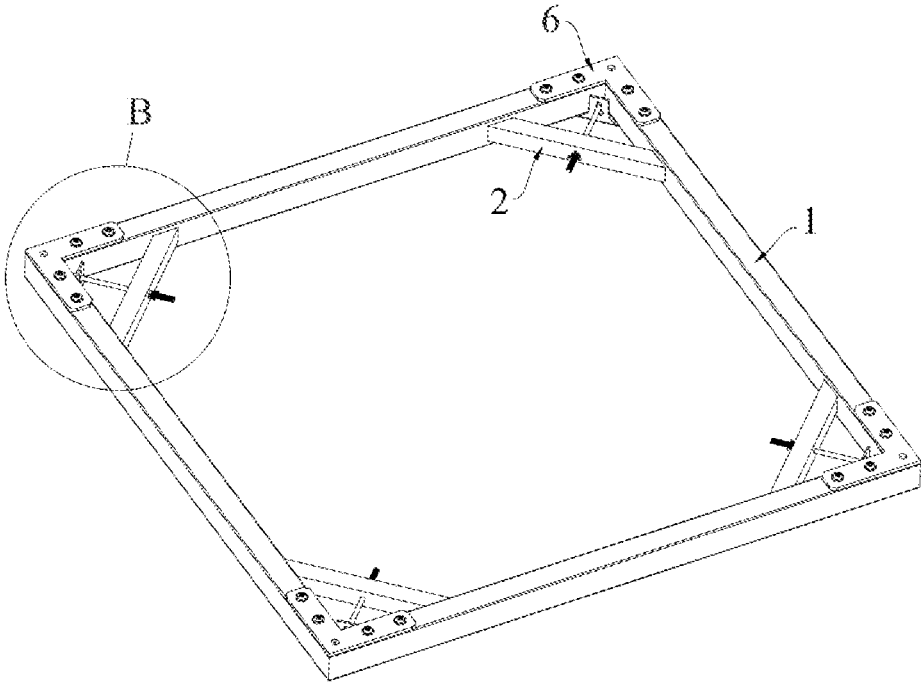
FIG. 3 is a structural diagram showing a rear axis side of a spliced frame according to the present disclosure.
Figure 4:
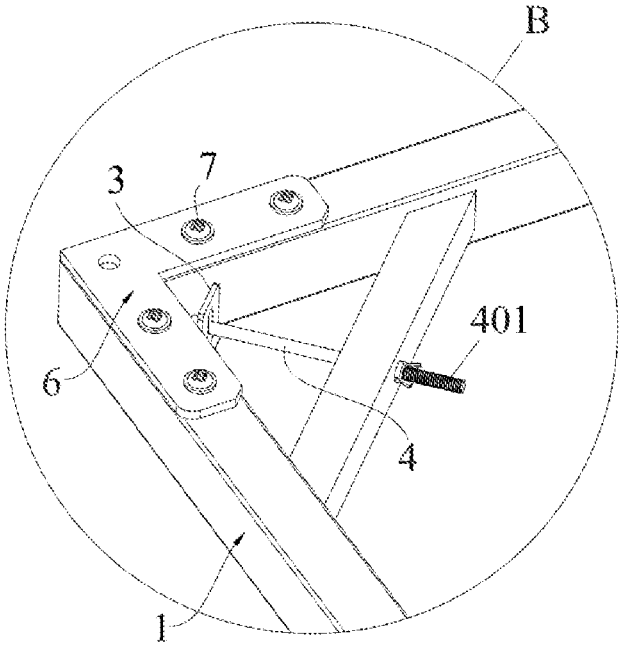
FIG. 4 is a partially enlarged view of part B in FIG. 2.
Figure 5:
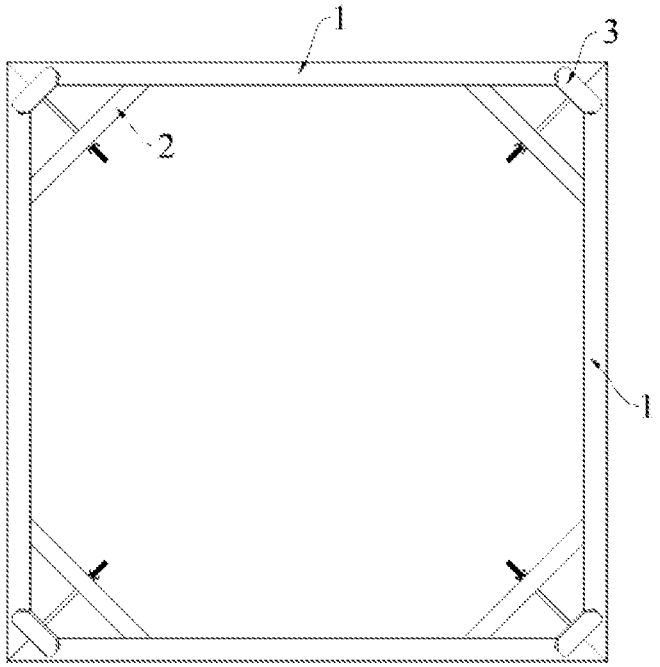
FIG. 5 is a front view of a spliced frame according to the present disclosure.
Figure 6:
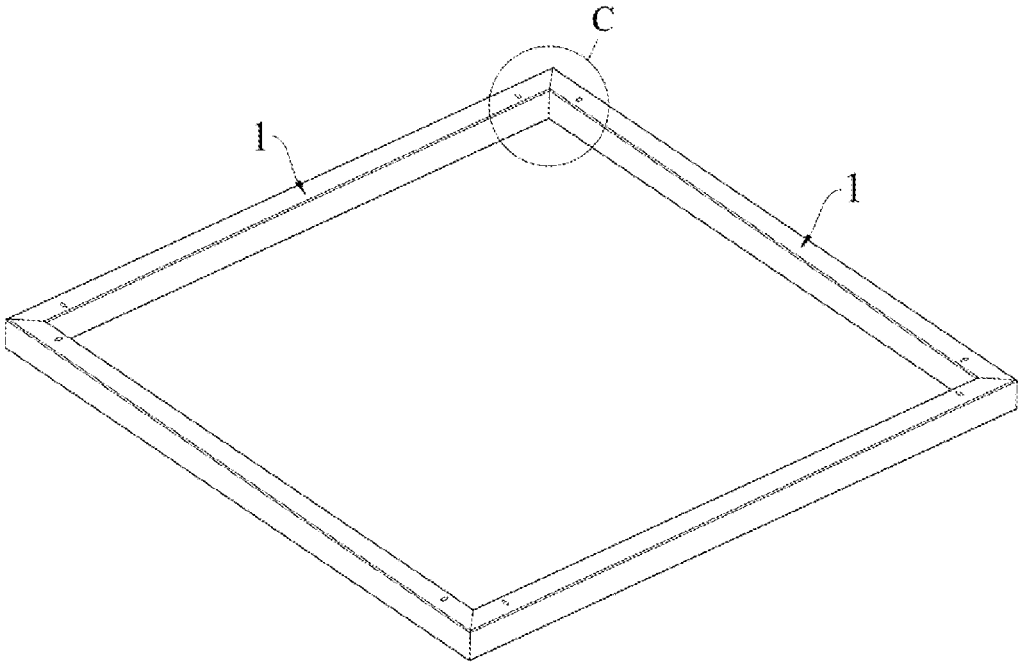
FIG. 6 is a structural diagram showing a front axis side of individual framed profiles connected with each other according to the present disclosure.
Figure 7:
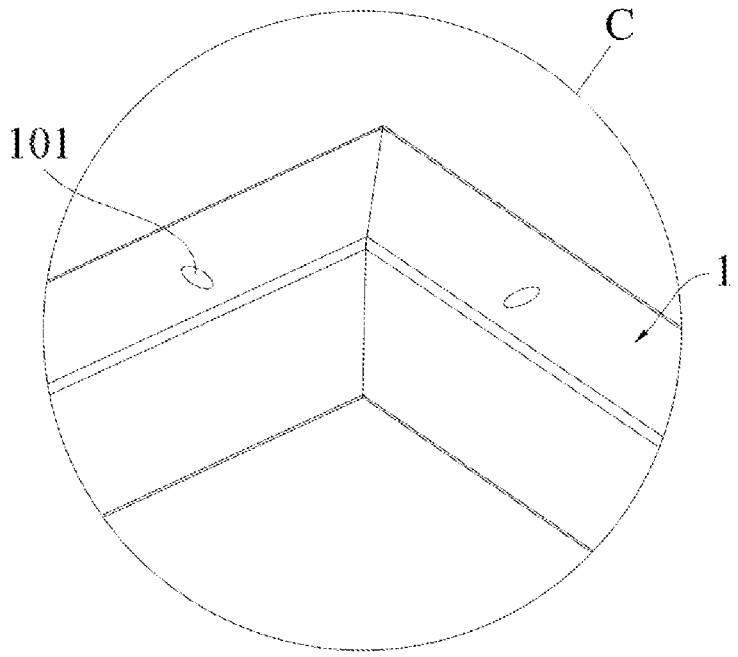
FIG. 7 is a partially enlarged view of part C in FIG. 6.
Figure 8:
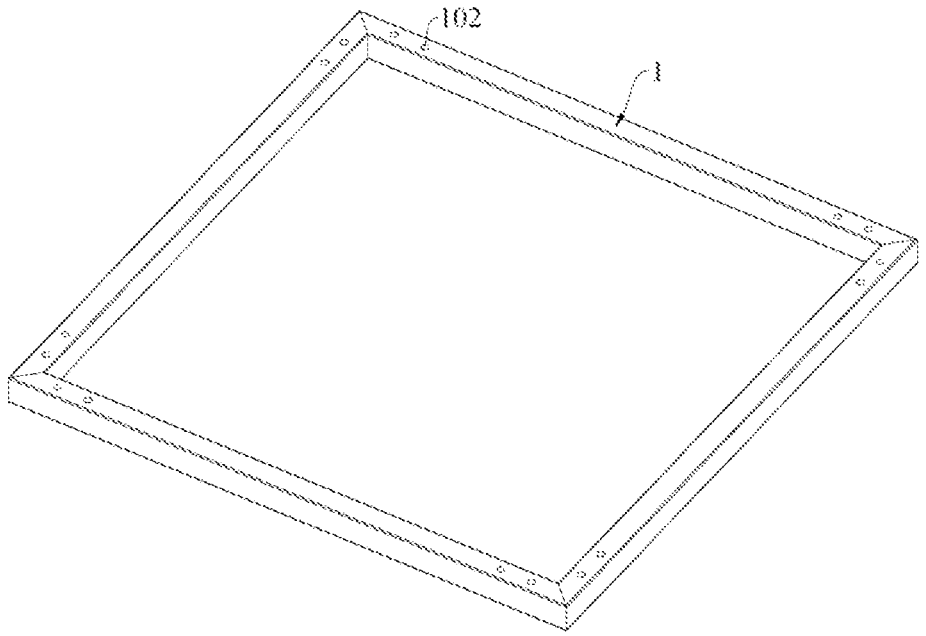
FIG. 8 is a structural diagram showing a rear axis side of individual framed profiles connected with each other according to the present disclosure.
Figure 9:
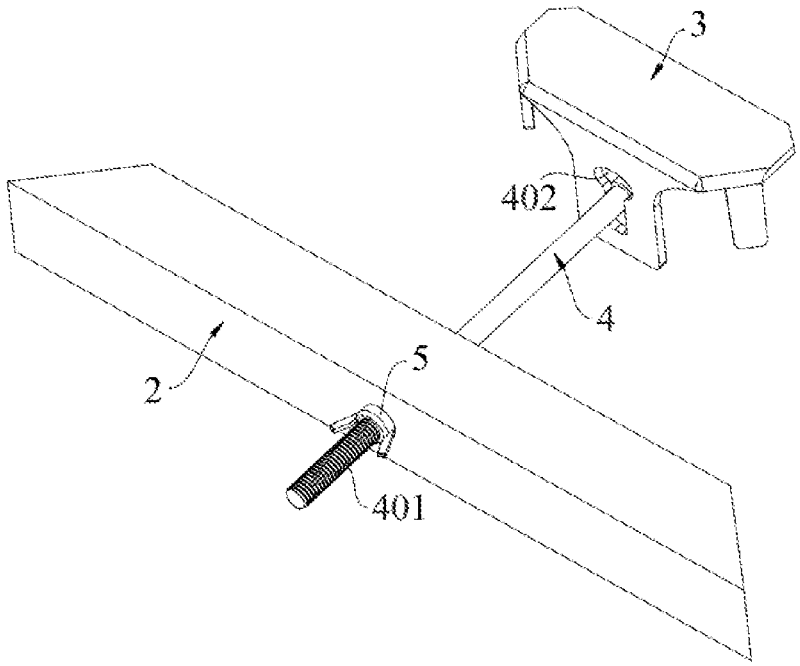
FIG. 9 is a structural diagram showing a first perspective of a corner clip, a positioning rod and a pushrod in a state where they are connected with each other according to the present disclosure.
Figure 10:
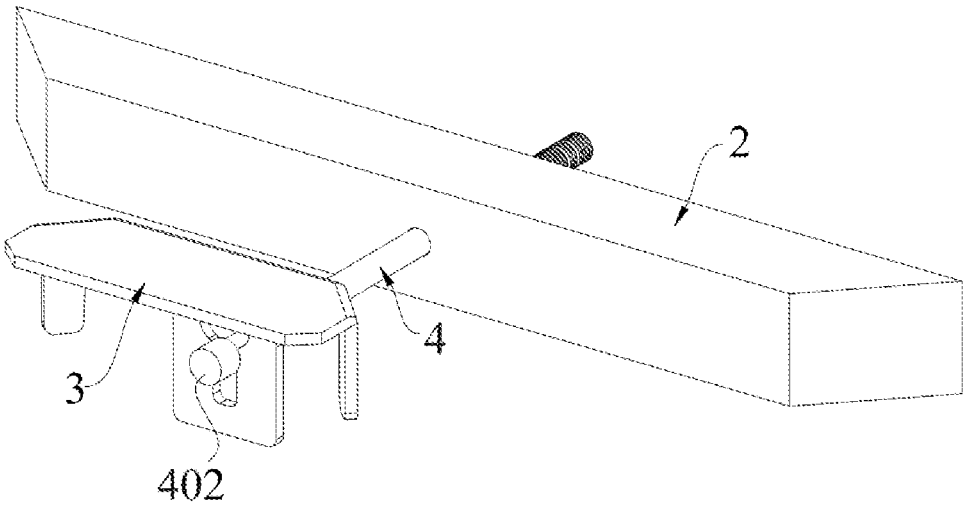
FIG. 10 is a structural diagram showing a second perspective of a corner clip, a positioning rod and a pushrod in a state where they are connected with each other according to the present disclosure.
Figure 11:
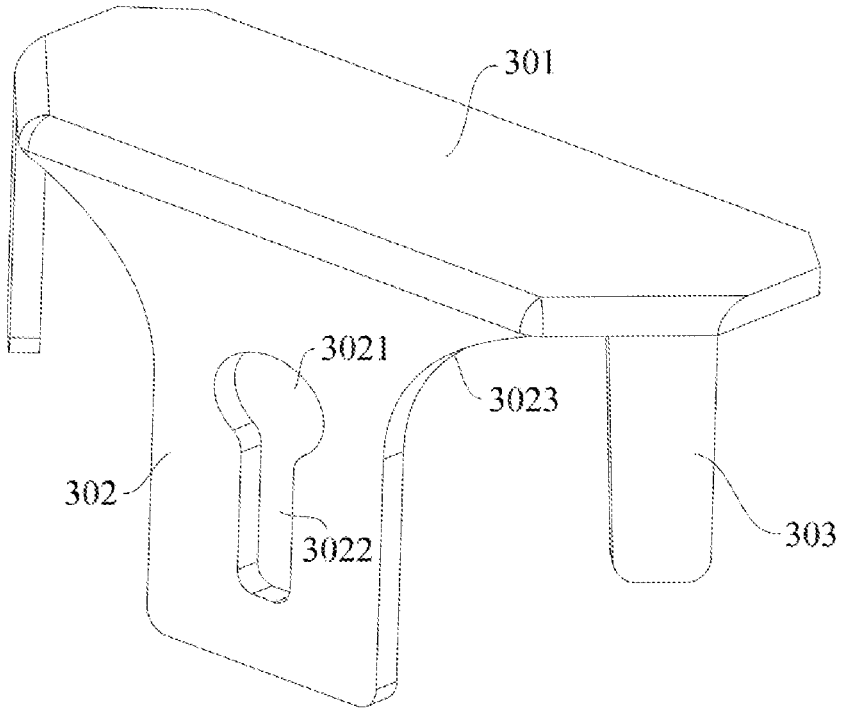
FIG. 11 a structural diagram showing an axis side of a corner clip of a frame according to the present disclosure.
Figure 12:
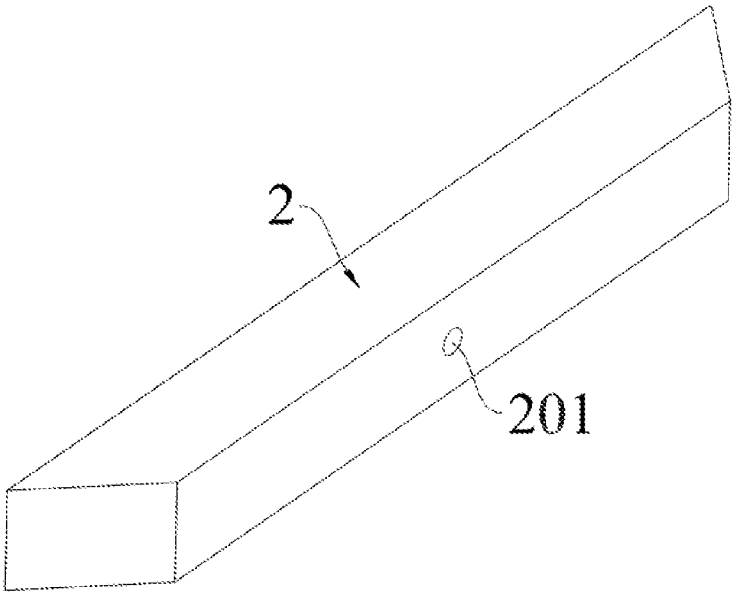
FIG. 12 is structural diagram showing an axis side of a pushrod according to the present disclosure.
Figure 13:
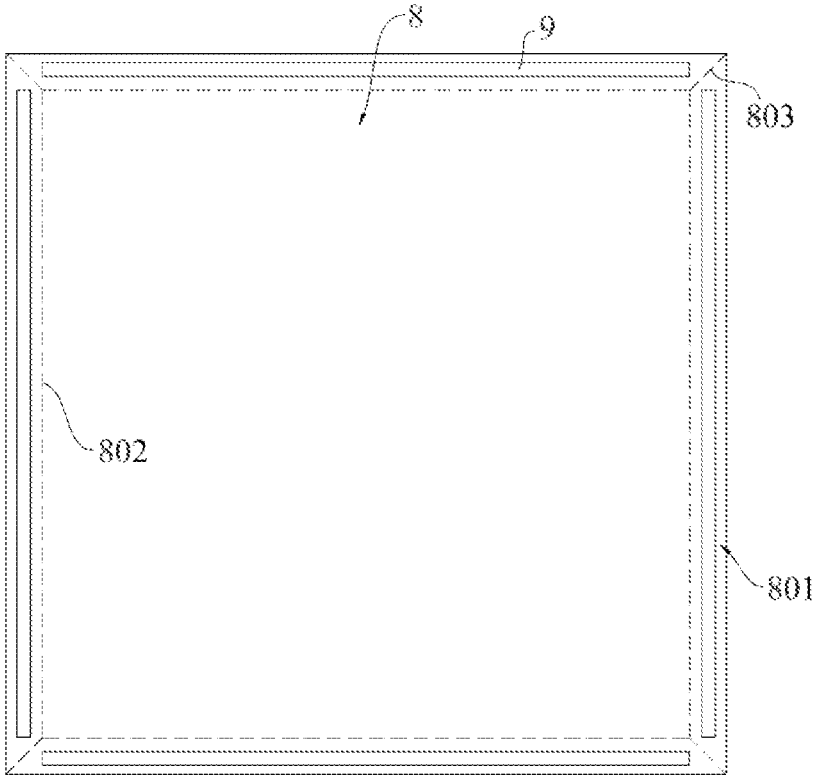
FIG. 13 is a schematic plan view of a canvas according to the present disclosure.

Specific embodiments: referring to FIGS. 1-13, the present disclosure provides a spliced frame, wherein the spliced frame includes:

- an outer frame, which is closed and is formed by a plurality of framed profiles 1 which are spliced with each other through their ends, and the ends of adjacent framed profiles 1 being connected to form a frame corner;
- a pushrod 2 having two ends slidably abutting against inside walls of the adjacent framed profiles 1 respectively, the pushrod 2 and two framed profiles 1 abutting against the pushrod 2 forming a triangular connection, and the pushrod 2 being provided with a through hole 201;
- a corner clip 3 mounted on the frame corner, and including an upper patch 301 and an inner flap 302 which are folded at an angle to each other, the upper patch 301 being fixedly mounted on upper end surfaces of the framed profiles 1, and the inner flap 302 being folded inward and extended to an inside of the outer frame, and the inner flap 302 being provided with a positioning hole; and
- a positioning rod 4, which passes through the through hole 201 and the positioning hole in turn, and is provided with a fastening structure for restricting a relative position between the pushrod 2 and the corner clip 3.

It should be noted that if there are four framed profiles 1, an outline of the outer frame is rectangular, and if there are three framed profiles 1, the outline of the outer frame is triangular, and the framed profiles 1 of different lengths or of the same length can be designed according to requirements to be suitable for a subsequent canvas installation.

Specifically, the ends of the adjacent framed profiles 1 are closely spliced with inclined surfaces, and the upper patch 301 is transversely connected between the adjacent framed profiles 1.

As a preferred embodiment of the present embodiment, opposite ends of the upper patch 301 are respectively provided with a pin 303 downwardly folded, and two sides of each of the upper end surfaces of the framed profiles 1 along a length direction are respectively provided with a clamping hole 101 in which the pin 303 is inserted.

Here, the design of the corner clip 3 has two advantages: one is that during the installation process, a relative position between adjacent framed profiles 1 can be approximately orientated, and since adjacent framed profiles 1 are joined obliquely, inclined surfaces of the adjacent framed profiles 1 can be abutted against each other to substantially determine the relative position during the installation process, and then the corner clip 3 is mounted thereon, and the upper patch 301 is transversely connected onto an upper side of a spliced position of the inclined surfaces, and two pins 303 are respectively connected to the two adjacent framed profiles 1, thereby serving as a primary fixing function for the two adjacent framed profiles 1, and the corner clip 3 is generally made of metal, which has strong deformation resistance and can effectively reduce a change degree of position between the adjacent framed profiles 1 in subsequent operations; and the other is that it can play the role of installation linkage with the pushrod 2 and the positioning rod in subsequent installation and fixation processes to form a stable triangular structure, the pushrod 2 and the two framed profiles 1 abutting against the pushrod 2 form a triangular configuration after the installation, the fastening structure is used to fasten and maintain the triangular configuration, which is extremely stable, when a position of the corner clip 3 changes to a certain extent (equivalent to a loosening of structure between the adjacent framed profiles 1), the positioning rod 4 will apply the corner clip 3 a lateral force to prevent the loosening, if a deformation is required, it is also necessary to bend a connecting position of the positioning rod 4 and the pushrod 2, or to deform the positioning hole to change a relative position of a connecting position of the positioning hole and the positioning rod 4, which undoubtedly requires overcoming a large force, and it means that by the above-described structure, the position of the corner clip 3 does not change and the relative positions of the framed profiles 1 do not change when the spliced frame in the technical solution has been assembled, and thus the structure is extremely stable.

In addition, in order to facilitate an installation of the corner clip 3, each of two ends of the inner flap 302 connected to the upper patch 301 is provided with an arc transition to form an arc angle 3023.

Furthermore, each of the inside walls of the framed profiles 1 is provided with a sliding bar extending in a length direction thereof, and each of the two ends of the pushrod 2 is inclined and provided with a sliding groove in which the sliding bar 101 can be slide.

Here, the sliding bar defines upper and lower positions of the two ends of the pushrod 2 on the inside wall of the framed profile 1. Moreover, the design of the positioning rod 4 and the corner clip 3 can effectively prevent a relative position of the pushrod 2 from changing. It is equivalent to that the adjacent framed profiles 1, the corner clip 3, the positioning rod 4 and the pushrod 2 are linked with each other, and after a relative position of each structure are fastened by the fastening structure, a finished structure is extremely stable.

Subsequently, the frame is provided with a spread state in which the inclined surfaces at the two ends of the pushrod 2 closely abut against the inside walls of the framed profiles 1.

As a preferred embodiment of this embodiment, a through hole 201 is provided through a middle position on a side of the pushrod 2, and pushrod 2 and the positioning rod 4 are perpendicular to each other. It should be noted that the through hole 201 is located at the middle position of the side of the pushrod 2 only when an outer contour of the outer frame is a regular polygon. When a user selects the framed profiles 1 of different lengths, that is, when the outer contour of the outer frame is a non-regular polygon, the pushrod 2 is still required to be kept perpendicular to the positioning rod 4, but the position of the through hole 201 on the side of the pushrod 2 can be adjusted adaptively according to an actual situation.

In this embodiment, the positioning hole includes an opening 3021 and a slot 3022 communicating with each other, wherein a bore diameter of the opening 3021 is larger than a bore diameter of the slot 3022. In this embodiment, the slot 3022 is located below the opening 3021.

Moreover, the slot 3022 is a strip-shaped slot, and the positioning rod 4 is engaged into the strip-shaped slot in the spread state.

The fastening structure includes a threaded rod 401, a nut and a limit block 402, wherein the threaded rod 401 integrally extends along a length direction of the positioning rod 4, and in the spread state, the nut is screwed on the threaded rod 401 and abutted on the pushrod 2. The limit block 402 is provided at one end of the positioning rod 4 away from the threaded rod 401, and an inner diameter of the limit block 402 is between the bore diameter of the opening 3021 and the bore diameter of the slot 3022.

During the installation, one end of the positioning rod 4 with the limit block 402 can be firstly extended into the opening 3021, and then the positioning rod 4 is move downward, so that the positioning rod 4 is engaged in the slot 3022, and the limit block 402 serves as an anti-detachment and limit for the positioning rod 4. In order to facilitate the installation, it is generally preferable to use a horn nut 5. The horn nut 5 is rotated until the horn nut 5 abuts on the pushrod 2, thereby a fastening is achieved.

More specifically, two sides of a lower end surface of the framed profile 1 along the length direction are respectively provided with at least one screw hole 102, and in the spread state, a corner connector 6 is mounted on a lower end surface of the frame corner through the at least one screw hole 102. The corner connector 6 is provided with a plurality of holes through which screws 7 can pass, and the holes are positioned in correspondence with the screw holes 102. Here, the corner connector 6 is configured to further limit the relative position of adjacent framed profiles 1 in order to make the structure more stable.

In addition, in this embodiment, when it is necessary to install a canvas on the spliced frame of the present disclosure to form an ornamental picture, the canvas 8 provided with an edgefold 801 at an edge ring of the canvas body can be adopted. A first fold 802 is provided between the edgefold 801 and the canvas body, so that the edgefold 801 can be folded and attached to an outside wall of the framed profile 1, and a paster 9 such as a double-sided adhesive can be optionally used for fixing. A second fold 803 is provided on the edgefold 801 corresponding to the connecting position of the adjacent framed profiles 1, and the second fold 803 is used to assist the edgefold 801 in folding at the frame corner.

The installation process of this technical solution is briefly described as follows:

First, two framed profiles 1 are preliminarily spliced through the inclined surfaces of the ends, and then two pins 303 of the corner clip 3 are respectively clamped into the clamping holes 101 of the two framed profiles 1, in order to preliminarily fix the relative positions of the two framed profiles 1 (it should be noted that when the corner clip 3 has been installed, the framed profiles 1 are pulled outwards, otherwise the structure of the corner clip 3 is easily destroyed), at this time, the upper patch 301 of the corner clip 3 is attached to the upper end surface of the frame corner, the inner flap 302 is folded inside the frame corner, and then the limit block 402 is inserted into the opening 3021 of the inner flap 302, and the positioning rod 4 connected to one end of the limit block 402 also passes through the opening, and when the positioning rod 4 loses support, it will fall into the slot 3022. Next, the sliding groove at one end of the pushrod 2 is slide along the sliding bar 101 of one of the framed profiles 1, and finally the sliding groove at the other end of the pushrod 2 is slide on the sliding bar 101 of the other framed profile 1. It should be noted that the position of the positioning rod 4 in the slot

3022 is required to be determined before the sliding groove at the other end of the pushrod 2 is slid onto the sliding bar 101 of the other framed profile 1, so that the threaded rod 401 at the other end of the position rod 4 can pass through the through hole, and finally the two framed profiles 1, the pushrod 2, the positioning rod 4 and the corner clip 3 can be fastened in relative positions by screwing the horn nut 5.

The above-mentioned spliced frame of the present disclosure is only a preferred embodiment of the present disclosure, which does not limit the scope of the patent of the present disclosure. Under the inventive concept of the present disclosure, the equivalent structure transformation made by using the contents of the specification and drawings of the present disclosure, or direct/indirect application in other relevant technical fields is included in the patent protection scope of the present disclosure.

What is claimed is:

1. A spliced frame, wherein the spliced frame comprises:

an outer frame, which is closed and is formed by a plurality of framed profiles which are spliced with each other through their ends, and the ends of adjacent framed profiles being connected to form a frame corner;

a pushrod having two ends slidably abutting against inside walls of the adjacent framed profiles respectively, the pushrod and two framed profiles abutting against the pushrod forming a triangular connection, and the pushrod being provided with a through hole;

a corner clip mounted on the frame corner, and comprising an upper patch and an inner flap which are folded at an angle to each other, the upper patch being fixedly mounted on upper end surfaces of the framed profiles, and the inner flap being folded inward and extended to an inside of the outer frame, and the inner flap being provided with a positioning hole; and a positioning rod, which passes through the through hole and the positioning hole in turn, and is provided with a fastening structure for restricting a relative position between the pushrod and the corner clip.

2. The spliced frame according to claim 1, wherein the ends of the adjacent framed profiles are closely spliced with inclined surfaces, and the upper patch is transversely connected between the adjacent framed profiles.

3. The spliced frame according to claim 2, wherein opposite ends of the upper patch are respectively provided with a pin downwardly folded, and two sides of each of the upper end surfaces of the framed profiles along a length direction are respectively provided with a clamping hole in which the pin is inserted.

4. The spliced frame according to claim 1, wherein each of the inside walls of the framed profiles is provided with a sliding bar extending in a length direction thereof, and each of the two ends of the pushrod is inclined and provided with a sliding groove in which the sliding bar can be slide.

5. The spliced frame according to claim 4, wherein the frame is provided with a spread state in which inclined surfaces at the two ends of the pushrod closely abut against the inside walls of the framed profiles.

6. The spliced frame according to claim 1, wherein a through hole is provided through a middle position on a side of the pushrod, and pushrod and the positioning rod are perpendicular to each other.

7. The spliced frame according to claim 5, wherein the positioning hole comprises an opening and a slot communicating with each other, wherein a bore diameter of the opening is larger than a bore diameter of the slot.

8. The spliced frame according to claim 7, wherein the slot is a strip-shaped slot, and the positioning rod is engaged into the strip-shaped slot in the spread state.

9. The spliced frame according to claim 7, wherein the fastening structure comprises a threaded rod, a nut and a limit block, wherein the threaded rod integrally extends along a length direction of the positioning rod, and in the spread state, the nut is screwed on the threaded rod and abutted on the pushrod, the limit block is provided at one end of the positioning rod away from the threaded rod, and an inner diameter of the limit block is between the bore diameter of the opening and the bore diameter of the slot.

10. The spliced frame according to claim 5, wherein two sides of a lower end surface of the framed profile along the length direction are respectively provided with at least one screw hole, and in the spread state, a corner connector is mounted on a lower end surface of the frame corner through the at least one screw hole.

* * * * *